United States Patent [19]

Dehais

[11] Patent Number: 4,604,965

[45] Date of Patent: Aug. 12, 1986

[54] APPARATUS FOR DEPOSITING A RING OF MATERIAL ON THE TIPS OF AMPOULES OR THE LIKE

[76] Inventor: Claude Dehais, 35, rue Godot de Mauroy, 75009 Paris, France

[21] Appl. No.: 587,960

[22] Filed: Mar. 9, 1984

[30] Foreign Application Priority Data

Mar. 10, 1983 [FR] France ..... 83 03947
Dec. 13, 1983 [FR] France ..... 83 19939

[51] Int. Cl.[4] ..... B05C 1/02

[52] U.S. Cl. ..... 118/219; 118/224; 118/225; 118/238; 118/239; 118/248

[58] Field of Search ..... 118/218, 219, 232, 233, 118/239, 211, 223, 224, 225, 238, 248

[56] References Cited

U.S. PATENT DOCUMENTS 2,085,389 6/1937 Purinton ..... 118/232 X
3,394,680 7/1968 Groves ..... 118/232
3,424,082 1/1969 Gray, Jr. ..... 118/233 X
3,545,402 12/1970 Dichter ..... 118/211 X
3,882,816 5/1975 Booz et al. ..... 118/239 X

*Primary Examiner*—John P. McIntosh
*Attorney, Agent, or Firm*—Larson & Taylor

[57] ABSTRACT

A machine is provided for depositing a ring of material on pharmaceutical ampoule tips or similar, said material being pasty or liquid at the time when it is deposited on said tips and being able then to be hardened, characterized in that it comprises means (4,5,6) for transporting said ampoules (3) in a line, these latter being disposed perpendicularly to their advancing direction; at least one reservoir (9) containing said material; and means (8) for transferring said material between said reservoir (9) and at least one of the tips of said ampoules (3). The invention also covers an assembly of such machines and the self-break ampoules provided with such a ring, made more especially from a plastic material, in particular at the level of the pre-break rings when it is a question of pharmaceutical ampoules with two self-break tips.

10 Claims, 7 Drawing Figures

APPARATUS FOR DEPOSITING A RING OF MATERIAL ON THE TIPS OF AMPOULES OR THE LIKE

The present invention relates first of all to a machine for depositing a ring of material on the tips of pharmaceutical ampoules or similar, said material being pasty or liquid when it is deposited on said tips and being capable then of being hardened.

The objects to be treated will be more especially, but not exclusively, well known pharmaceutical ampoules of the type with two tips or of the "bottle" type.

As for the ring of material, which will be deposited on at least one of the ampoule tips and preferably on both tips, it may be formed from a plastic material, possibly colored for the purpose for example of providing coded information. This ring, made in particular from a plastic material may, according to an essential arrangement of the present invention, be deposited at the level of a prebreak ring formed in the glass, in the case of self breakable ampoules, that is to say which may be opened without a file, the ring of plastic material then allowing the splinters of glass which might occur during breaking of the tip at the end of the ampoule to lodge and be fixed therein, which then prevents them from harming the user or from being carried away with the contents of the ampoule.

The purpose of such a machine in accordance with the present invention is essentially for the formation, more particularly but not exclusively, of self breakable pharmaceutical ampoules provided, preferably at both their tips, with rings of a plastic material which may be colored or not.

The aim of the present invention is more particularly to obtain an entirely automated high yield production with a machine whose operation is entirely reliable and requires only reduced supervision.

For this, a machine of the above defined type will, in accordance with the present invention, be essentially characterized in that it comprises means for transporting said ampoules in a line, said ampoules being disposed perpendicularly to the direction of their advance; at least one reservoir containing said material; and means for transferring said material between said reservoir and at least one of the tips of said ampoules.

For depositing a given material simultaneously on both tips of the ampoules, such a machine may comprise two assemblies of said transfer means, which assemblies will then be disposed on each side of said line of ampoules, facing each other.

In an advantageous embodiment of the invention, such a machine may further be characterized in that said transfer means comprise a rotary disk having an essentially horizontal axis, whose lower part bathes in said reservoir, the ampoule tip concerned being able to be brought into contact with the emerging part of the edge of the disk at a position corresponding to the part to be treated.

The machine may further comprise drive means adapted for causing the ampoules to rotate about their axis, at least at the moment of coating their tips with said material, so as to improve and make uniform the distribution of the material all around the ampoule tip.

It will be particularly advantageous, for this purpose, to adapt said drive means so as to rotate the ampoules in a direction such that, in the tangency plane between the edge of the disk and the ampoule tip concerned, the surface of said tip and that of the edge move in opposite directions.

As for said means for transporting the ampoules, they may, in a first embodiment of the invention, comprise transporting chains or similar, having members for driving the ampoules individually, and at least one wheel with peripheral cups each adapted to support an ampoule at least during coating thereof, the peripheral speed of said cups being the same as the advancing speed of said chains.

So as to prevent the ampoules from being scratched in the cups, each of these latter may be associated with rolling support means.

In the most frequent case, in which the machine will comprise two assemblies of transfer means disposed on each side of the line of ampoules for depositing the material simultaneously on both tips of the ampoules, it will be further appropriate for said cup wheel to be disposed, generally coaxially, between the rotary disks of the two assemblies of transfer means.

In a second embodiment of the invention, which could moreover be used in the case of "bottle" ampoules, that is to say having only a single self breakable tip, the machine may be characterized in that said means for transporting the ampoules are of the step by step feed type, and in that it comprises means adapted to actuate said transfer means at the moment when said feeding movement is stopped.

Said transport means of the step by step feed type may be formed in different ways, as long as the assembly of ampoules is motionless at a given moment.

A chain transporter could for example be used whose advance is controlled by a ratchet wheel system or any other equivalent system.

In another variant, the machine could be further characterized in that said means for transporting the ampoules comprise two pairs of notched bars extending parallel to each other in the feed direction of the ampoules, one of said pairs being moveable with a circular movement so as to cause the ampoules to advance with a so called "pilgrim" step, and in that it further comprises lifting means adpated to raise an ampoule, at least during coating of its tips, so as to cause it to leave its seat on said bars.

Said lifting means may comprise a support which is vertically moveable under the action of a cam or similar, this support being provided with rolling means for the ampoule concerned.

This vertically mobile support may be disposed in opposition with a rotary drive roller with fixed axis on which the ampoule concerned is able to come to bear when said lifting means are actuated, so as to rotate about its axis.

In the case already mentioned in which the machine comprises two assemblies of transfer means, it may be further advisable to dispose said lifting means between the rotary disks of said two assemblies.

In this second embodiment of the invention, using transport means ensuring the so called "pilgrim" step, the machine may be further characterized in that said assemblies of transfer means are associated with pivoting means adapted to be controlled in synchronism with said lifting means, so as to impart to said transfer means a rising movement allowing them to cause the ampoule tips to be coated.

The invention further relates to an assembly of several machines such as defined above, such an assembly being able to be essentially characterized in that it comprises at least two machines, one receiving the ampoules treated by the preceding one, and in that said means for transporting said ampoules or similar in a line are substantially common to the different machines.

Such an assembly, as will be seen hereafter, may be particularly compact and easily adaptable to existing production lines.

The present invention also relates to the ampoules, in particular self-break pharmaceutical ampoules, characterized in that they have, over the pre breakage ring, a coating of plastic material, this coating overlapping the ring on each side and having preferably a thickness of a few tenths of a millimeter.

Two embodiments of an assembly of machines in accordance with the present invention will now be described by way of examples which are in no wise limiting, with reference to the Figures of the accompanying drawings in which.

Figure 2:
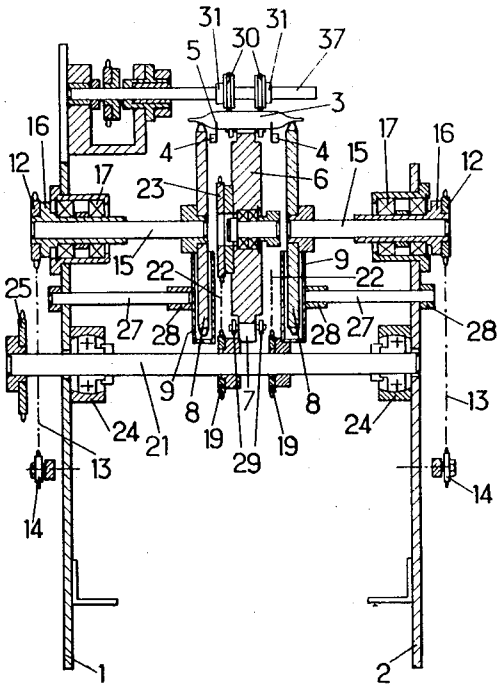
FIG. 2 is a sectional view through line II—II of FIG. 1.
Figure 1:
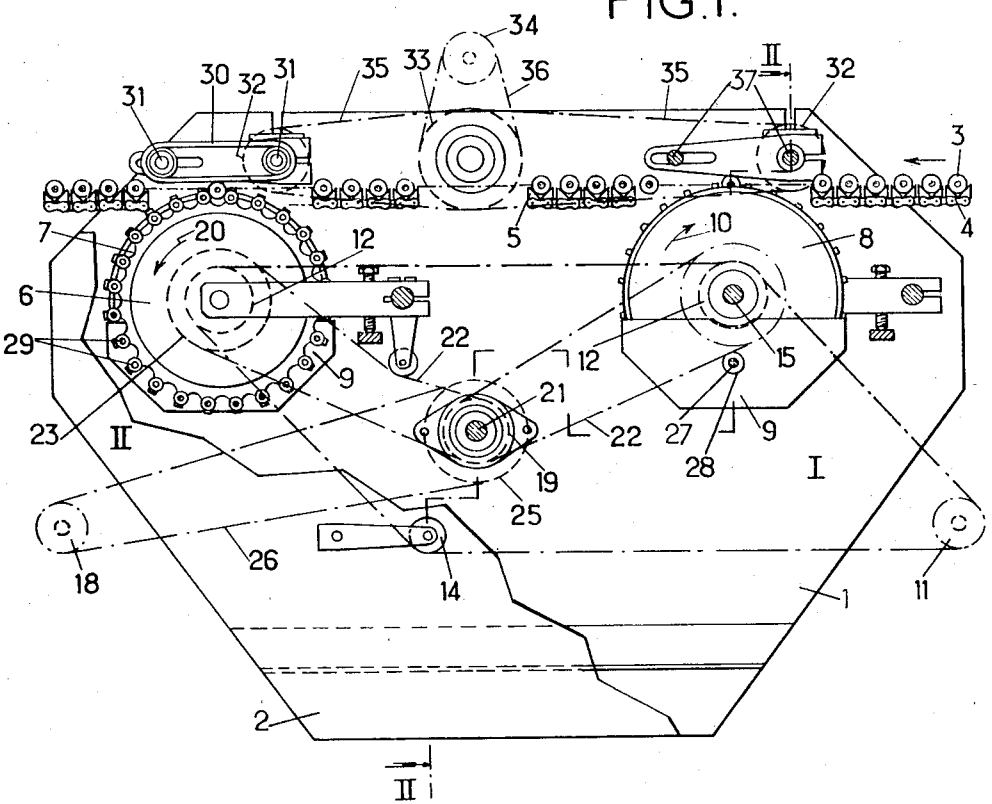
FIG. 1 shows schematically, in elevation and with parts cut away, a first assembly of machines in accordance with the present invention, in which assembly said transport means are of the transporter chain type.

The assembly of machines shown schematically in FIGS. 1 and 2 comprises two successive machines (working in series) and having a common frame, shown by the two frame elements 1 and 2, which carry the essential part of the different means of the two machines, motor driven variators, control members and others.

These two machines of the assembly, namely an input machine I and an output machine II, substantially similar to each other, comprise common transport means adapted to cause a line of pharmaceutical ampoules 3 with two tips to pass through said assembly I–II from right to left in FIG. 1. These ampoules extending in a substantially horizontal layer, and each ampoule being orientated perpendicularly to the direction of its advance. Said common transport means comprise, among other things, two parallel transporting chains 4 of the articulated link type, on which individual V shaped drive members or brackets are mounted, which are referenced at 5. Thus, the body of each ampoule may be supported, proximate its ends, by each pair of opposite members 5. Said transport means further comprise for each machine I, II a wheel 6 with peripheral pockets 7, disposed in the axis of the line of ampoules, coaxially, and between two rotary disks 8 with horizontal axis.

In FIG. 1, because of the parts cut away, the wheel 6 of machine II and a disk 8 of machine I may be seen but, as was mentioned above, these two machines are essentially identical. Consequently, and for the sake of simplicity, the parts which are similar in both machines have been designated by the same references.

The lower part of each of disks 8 is immersed in a reservoir 9 containing the material to be transferred, in the form of a ring, to the tips of the ampoules. Reservoirs 9 are connected to the corresponding frame element 1 or 2 by rods 27 engaged in welded sleeves 28.

The rotary disks 8 are driven, in the clockwise direction of arrow 10, by a conventional toothed wheel 11, 12 and chain 13 system, reference 14 designating a tensioning roller. As can be seen, this drive system is common to both machines I and II and is the same on each side, for the two disks 8 of the same machine.

As can be seen in FIG. 2, disks 8 are fixed on shafts 15 on which are also fixed sockets 16 integral with the toothed wheels 12, the sockets being mounted in apertures in the chassis elements 1, 2 by means of bearings 17.

The cup wheels 6 are, as far as they are concerned, driven in the anticlockwise direction of arrow 20 in synchronism with chains 4, from a common shaft 21, by a system comprising, for each machine, a toothed wheel 19 fixed on shaft 21, a chain 22 and a toothed wheel 23 (only one of which is visible in FIG. 2), which is fixed on the corresponding wheel 6. Shaft 21 is supported by the chassis elements 1, 2 through bearings 24 and is driven by a toothed wheel 18, 25 and chain 26 system.

Such being the case it can be seen that, when an ampoule reaches the upper part of a cup wheel 6, it is taken over by the cup 7 which appears at that moment opposite it and is then slightly raised outside the drive members 5. As can be seen in FIG. 2, the two tips of the ampoule may then rub against the upper part of the edges of the rotary disks 8, which edges are coated with the liquid or pasty material taken from the respective reservoirs 9.

So as to obtain excellent distribution on the ampoule tips, that is to say so as to obtain a peripheral ring of uniform width and thickness, it is preferable for the ampoules 3 to be set in rotation about their longitudinal axis during this contacting.

For this, first of all, rolling support means are provided for each of the cups 7 of wheel 6 of each of the machines I and II, such means being formed for example, for each of the cups, by two small rollers 29. Each ampoule 3 may thus rotate in the corresponding cup 7 without risk of being scratched.

For driving the ampoules, the lower runs of two parallel belts 30 stretched between two pairs of grooved pulleys 31 may for example be used, which may be rotated hereagain by toothed wheel 32, 33, 34 and chain 35, 36 systems, said grooved pulleys 31 of each pair of pulleys being mounted on a common shaft 37.

Preferably, the direction of rotation of the pulleys is such that, in the tangency plane between the edge of disks 8 and the ampoule tip concerned, the surface of the ampoule tip and that of said edge move in opposite directions. In effect, the rubbing thus provided allows a very homogenous thickness of the ring of material deposited on the ampoule to be obtained while avoiding more especially a thickness of the ring which is too great.

Such coating of the two tips of the ampoule concerned being thus carried out, the ampoule is then replaced on the drive members 5 of the transport means and discharged from the corresponding machine I or II.

Machine I may in particular be used for depositing on the ampoule tips a first so called "priming" material so that the plastic material forming the rings properly speaking of the ampoules may adhere firmly thereto, this plastic material deposited on the ampoule tips by machine II being then cured and hardened.

It goes without saying that more than two machines in series could be provided by using generally the same type of means if it is required to form on the ampoule tips coating rings of a more complex structure.

In any case, with the present coating of the pharmaceutical ampoule tips with a plastic material ring deposited at the level of the usual prebreakage rings, the decisive advantage will be obtained, with respect to presently known ampoules, that when the user breaks the tips without a file, he will not risk hurting himself, and the splinters of glass which may be produced remain lodged in the plastic material of the ring. For the same reason, the risk of splinters of glass being carried along with liquid contained in the ampoule will be positively avoided.

It should be noted moreover that one of the two materials used, namely the one contained in reservoirs 9 of machine I or that contained in the reservoirs 9 of machine II may possibly be colored according to a given code, supplying for example information concerning the contents of the ampoule.

Figure 4:
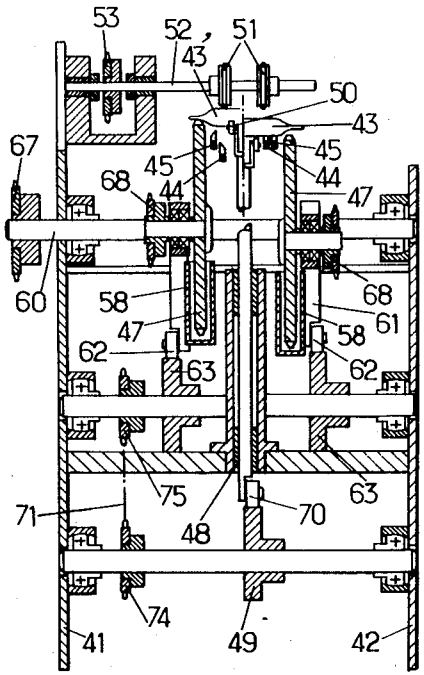
FIG. 4 is a sectional view through line IV—IV of FIG. 3.
Figure 3:
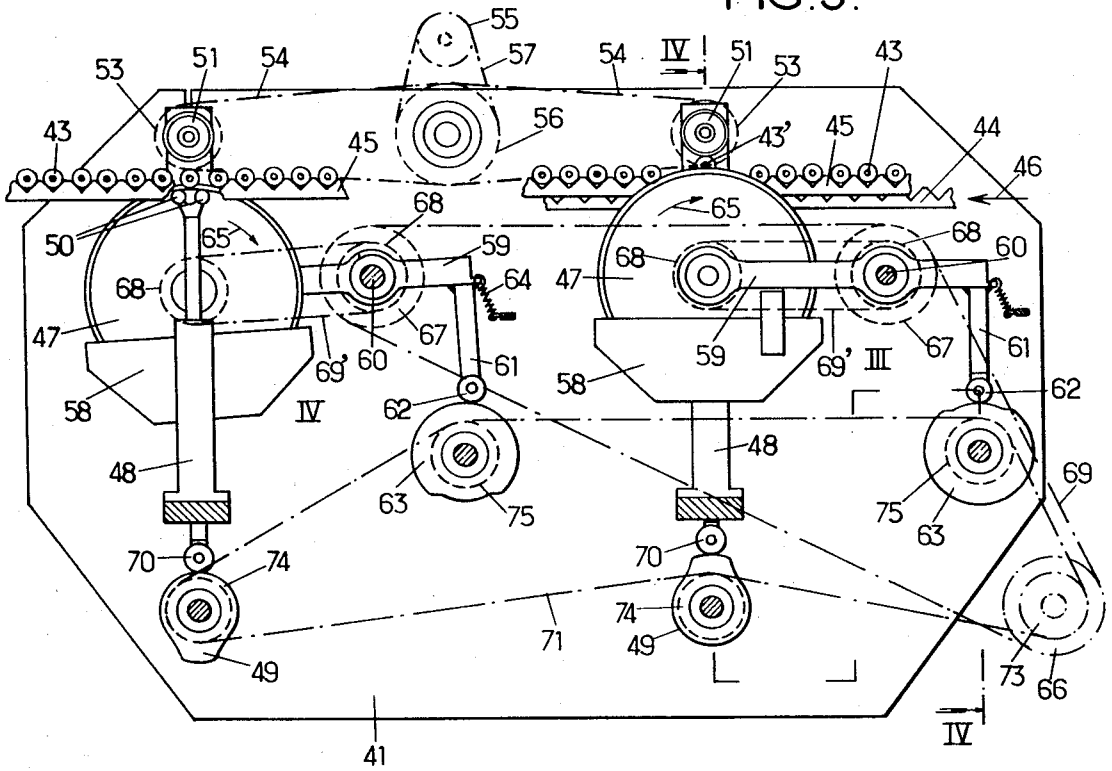
FIG. 3 shows schematically in elevation a second assembly of two machines also in accordance with the present invention, in which assembly said transport means are of the notched bar type.

Machines III and IV of the machine assembly shown in FIGS. 3 and 4, to show a possible variant of construction, comprise, as common frame elements, those referenced at 41 and 42 which have generally the same role as elements 1 and 2 of the previously described mahcines I and II.

This machine assembly of FIGS. 3 and 4 is distinguished from that of FIGS. 1 and 2 first of all by the use of different means for transporting the line of ampoules, which are here referenced at 43. In fact, in this embodiment, two pairs of notched bars 44 and 45 are used all extending in the direction of advance of the ampoules, the two bars 44 being mobile in two parallel vertical planes, with respect to the two bars 45 which are fixed.

As can be seen in the sectional view of FIG. 4, the fixed bars 45 are disposed outwardly of the mobile bars 44, but the arrangement could of course be reversed. Such being the case, the two bars 44 are caused to move, by appropriate means (not shown), with a circular movement at the end of the rising part of which ampoules 43 supported in their notches are transferred into the notches of the fixed bars 45, and this each time one notch further forward, namely in the direction of arrow 45, the whole of the ampoules supported by bars 44 thus progressing as one, this step by step advancing movement being known under the name of "pilgrims' step".

Since the advancing movement of ampoules 43 is thus discontinuous, the dwell time is used to subject the ampoule to be coated with a lifting movement at the end of which, on the one hand it is rotated about its axis and, on the other, the upper parts of the edges of coating disks 47 are brought into contact with the tips of the ampoule concerned.

For this, each machine III, IV comprises first of all lifting means adapted to raise the ampoule concerned so as to cause it to leave its seat on bars 44–45. These lifting means comprise for example a support 48 which is vertically moveable under the action of a cam 49 acting on the support through a roller 70, this cam being of course synchronized in each of the machines III and IV with the kinematics of the mobile bars 44. At its upper part, the vertically mobile support 48 comprises rolling means for said ampoule concerned 43, these means being formed for example by small rollers 50 similar to the small rollers 29 of the embodiments shown in FIGS. 1 and 2.

With these means, the ampoule concerned 43 may be raised while being able to pivot about its axis, the rotational movement thereof being obtained by a pair of rollers, for example with a rubber tyre, referenced at 51 and fixed on a common shaft 52 rotated by a toothed wheel 53. The toothed wheel of each machine is rotated by a chain 54, which is connected kinematically to a common drive toothed pinion 55 through a toothed wheel 56 and chain 57 system.

Taking into account this rising movement of the ampoule to be coated 43, this ampoule being shown in such a position (43') in machine III whereas it is in a low position in machine IV, it is advisable to cause a synchronized lifting movement of the above mentioned pairs of coating disks 47, the lifting movements of the pairs of disks 47 of one machine not however being necessarily synchronized with a lifting movement of the pair of coating disks 47 of the other machine. The essential thing is, in any case, that lifting of the two coating disks 47 of the same machine takes place in synchronism with the lifting movement of the corresponding mobile support 48.

For this, the two pairs of coating disks 47, as well as their respective reservoirs 58 are mounted at one end of pivoting arms 59 mounted for pivoting on fixed shafts 60, the other end of these arms being subjected alternately to upward and downward movements through a right angled leg 61 having at its end a roller 62 held constantly in abutment against a cam 63. This constant abutment of rollers 62 on the respective cams 63 is provided by the pulling action of a spring 64. Each cam 63 is synchronized with a cam 49 of the same machine so that, of course, lifting of the assembly 47–58 takes place exactly at the same time as lifting of the ampoule through the vertically mobile support 48.

Thus there will be obtained, in each machine III and IV, simultaneous coating of the two tips of the ampoule concerned 43, when this latter is in its high position 43', at the same time as it is rotated by the above mentioned means 51–57.

In the embodiment of FIGS. 3 and 4, the mobile supports 48 move vertically in opposition, but it could of course be provided for them to move on the contrary exactly in phase.

The drive and transmission means for the different movements may be quite similar to those of the assembly described with reference to FIGS. 1 and 2, and comprise in particular one or more motor driven reducers and toothed wheel and chain transmissions, the shafts of these different wheels being supported, through appropriate bearings, between the two frame elements 41 and 42. Since these arrangements are quite similar to those described with reference to FIG. 2, they will not be described in detail here.

The two coating disks 47 are, in each machine III or IV, rotated for example in the clockwise direction shown by arrow 65, through a toothed wheel 66, 67, 68 and chain 69, 69' system.

As for the different cams 63 and 49, each one is fixed on the same shaft as a toothed wheel and these wheels are rotated by means of a chain 71 meshing with a toothed drive wheel 73, which is mounted on the same shaft as the toothed wheel 66. The toothed wheels associated with cams 49 have been referenced at 74, and those associated with cams 63 have been referenced at 75.

Of course, an assembly of machines III–IV may provide generally the same type of advantages as an assembly of machines such as the one described with reference to FIGS. 1 and 2, namely to provide more especially automatic coating of pharmaceutical ampoule tips by means of an appropriate material adapted to avoid the above mentioned disadvantages of conventional self breakable ampoules, and this with previous application of a priming product promoting adherence of the plastic material.

In all cases, by adjusting the speed of the coating disks (8 or 47) the thickness of the products deposited on the ampoule tips or other objects may be conveniently adjusted.

The plastic material used may be cured either directly at the ambient temperature of the surrounding air, or with heat supplied by means of a gas burner or an electric resistance.

Figure 5:
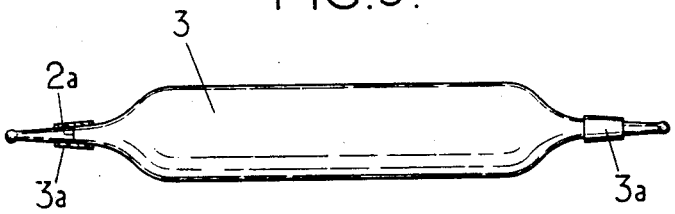
FIG. 5 shows a self breakable pharmaceutical ampoule with two tips, the coating of one of these latter being shown in section and the other in an external view.
Figure 6:
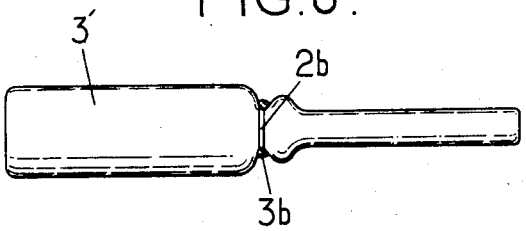
FIG. 6 shows a self breakable ampoule of the "bottle" type.
Figure 7:
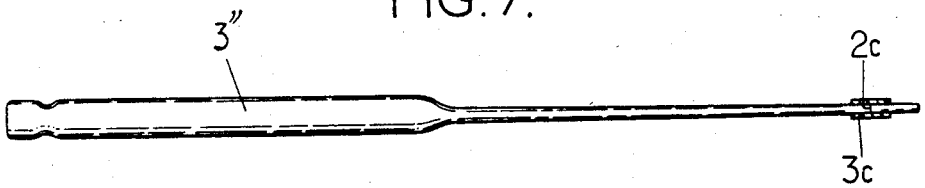
FIG. 7 shows a self breakable pipette of the "Pasteur" type, the coatings being shown in FIGS. 6 and 7 in section.

In the FIGS. 5 to 7, the ampoules or similar are referenced at 3, 3' and 3'' and their respective prebreakage rings at 2*a, b* and *c*. They may be prebreakage rings made in a conventional way either by diamond cutting or with a metal disk and may be of the so called "color break" type (colored prebreakage ring).

In accordance with the invention, each of these prebreakage rings, referenced respectively at 3*a, b* and *c*, is covered with plastic material coating, formed by one or other of the machine assemblies which have just been described.

As plastic material for obtaining the required qualitites for this coating, different types of plastic materials may be used and more especially the following ones:

all the resin ranges;
all the range of silicones;
all the range of rubbers and compounds;
all the range of elastomers;
all the range of plastics, of the phenoplast, polyacetate, polyamide, polycarbonate, polychloride, polyester, polyethylene, polyimide, polymercaptan, polyolefin, polyphenylene, polypropylene, polysulfone, polyterephtalate, polyurethane, and polytetrafluorethylene types;
all the range of epoxydes;
all the range of vinyls.

As was mentioned above, and depending on the case, the materials used may be cured either directly at the ambient temperature, or with heat application.

As can be clearly seen in FIGS. 5 to 7, coatings 3*a, b* and *c* overlap the respective prebreakage rings, that is to say that they extend slightly on each side of these rings; their thickness will be of a few tenths of a millimeter.

The plastic material coatings at the level of the prebreak rings will prevent the user from hurting himself when opening the ampoule or similar, for the glass splinters which may be produced will remain lodged in these coatings. For the same reason of course, the liquid contained in the ampoule will not take with it the splinters of glass when it flows.

Furthermore, the plastic material coats will better protect the ampoules or similar from the risk of breakage during the different handling operations to which they are subjected, more especially during packing thereof in the laboratory.

I claim:

1. A machine for depositing a ring of plastic material on the tips of pharmaceutical ampoules or the like, which material is pasty or liquid at the moment when it is deposited on said tips and which subsequently hardens, comprising: advancing means for advancing said ampoules in a line, said ampoules being disposed perpendicularly to the direction of their advance; at least one reservior containing said plastic material; transfer means for transferring said plastic material between said reservoir and at least one of the tips of said ampoules, said transfer means comprising a rotary disk with an essentially horizontal axis, the lower part of which disk bathes in said reservoir, said advancing means including means for bringing each advancing ampoule tip into contact with the emerging part of the edge of the disk; and drive means for rotating the ampoules about their axes, at least at the moment when their tips are being coated with said material, said advancing means comprising transporting chains or the like having members for individually driving the ampoules, and at least one wheel having peripheral cups, each of which cups supports an ampoule, at least at the time of coating that ampoule, the peripheral speed of said cups being the same as the advancing speed of said chains.

2. The machine according to claim 1, comprising two assemblies of transfer means disposed parallel to each other on opposite sides of the centerline of said line, for depositing a given material simultaneously on opposite tips of the ampoules.

3. The machine according to claim 1, wherein said drive means rotates the ampoules in a direction such that, in the tangency plane between the edge of the said disk and the ampoule tip being coated, the surface of said tip and the surface of said edge move in opposite directions.

4. The machine according to claim 1, each of said cups having rolling support means.

5. The machine according to claim 1, comprising two assemblies of transfer means disposed parallel to each other on opposite sides of the centerline of said line, for depositing a given material simultaneously on opposite tips of the ampoules, and wherein said wheel having said cups is disposed, generally coaxially, between the rotary disks of the two assemblies of said transfer means.

6. An assembly of machines for successively depositing rings of different materials on pharmaceutical ampoule tips or the like, comprising at least two machines according to claim 1, one of said machines receiving the ampoules treated by the preceding one, and wherein said advancing means is common to the at least the two machines.

7. A machine for depositing a ring of plastic material on the tips of pharmaceutical ampoules or the like, which material is pasty or liquid at the moment when it is deposited on said tips and which subsequently hardens, comprising: advancing means for advancing said ampoules in a line, said ampoules being disposed perpendicularly to the direction of their advance; at least one reservoir containing said plastic material; transfer means for transferring said plastic material between said reservoir and at least one of the tips of said ampoules, said transfer means comprising a rotary disk with an essentially horizontal axis, the lower part of which disk bathes in said reservoir, said advancing means including means for bringing each advancing ampoule tip into contact with the emerging part of the edge of the disk; and drive means for rotating the ampoules about their axes, at least at the moment when their tips are being coated with said material, said advancing means being of the step by step advance type, and including means for acuating said transfer means at the time when said advancing means is stopped, said step by step advancing means comprising two pairs of notched bars extending parallel to one another in the advancing direction of the ampoules, one of said pairs being movable with respect to the other with a circular movement so as to cause the ampoules to advance with a so-called "pilgrim step" and wherein the advancing means further comprises lifting means for raising an ampoule, at least at the time of coating its tips, so as to cause the ampoule to leave its seat on said bars, and said lifting means comprising a vertically mobile support movable in the vertical direction under the action of a cam or the like, said support being provided with rolling means for the ampoule being coated.

8. The machine according to claim 7, wherein said vertically mobile support opposes a rotary drive roller having a fixed axis, on which drive roller the ampoule being coated bears when said lifting means is actuated so as to roatate the ampoule about its axis.

9. The machine according to claim 8, said transfer means comprising two assemblies of transfer means disposed parallel to each other on opposite sides of the centerline of said line, for depositing a given material simultaneously on opposite tips of the ampoules, said lifting means being disposed between the rotary disks of the two assemblies of transfer means.

10. The machine according to claim 9, wherein said assemblies of transfer means are associated with pivoting means operable in synchronism with said lifting means for raising said transfer means to ensure coating of the ampoule tips.

* * * * *